US007145288B2

(12) United States Patent
Shimizu

(10) Patent No.: US 7,145,288 B2
(45) Date of Patent: Dec. 5, 2006

(54) IMAGE DISPLAY APPARATUS HAVING SPACER WITH RESISTANCE FILM

(75) Inventor: Yasushi Shimizu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 10/915,399

(22) Filed: Aug. 11, 2004

(65) Prior Publication Data

US 2005/0062401 A1 Mar. 24, 2005

(30) Foreign Application Priority Data

Aug. 12, 2003 (JP) ..... 2003-292408

(51) Int. Cl.
*H01J 1/62* (2006.01)

(52) U.S. Cl. ..... 313/495; 313/292

(58) Field of Classification Search ..... 313/495–497, 313/422, 479, 292
See application file for complete search history.

(56) References Cited

U.S. PATENT DOCUMENTS

| | | | | |
|---|---|---|---|---|
| 5,760,538 | A | 6/1998 | Mitsutake et al. | 313/422 |
| 5,939,822 | A | 8/1999 | Alderson | 313/493 |
| 6,494,757 | B1 | 12/2002 | Yamazaki et al. | 445/24 |
| 6,656,007 | B1 | 12/2003 | Fushimi et al. | 445/24 |
| 6,777,868 | B1 * | 8/2004 | Kosaka et al. | 313/495 |
| 6,809,469 | B1 | 10/2004 | Ito et al. | 313/495 |
| 2002/0123292 | A1 | 9/2002 | Yamazaki et al. | 445/24 |
| 2003/0003838 | A1 | 1/2003 | Yamazaki et al. | 445/24 |
| 2004/0041507 | A1 * | 3/2004 | Ito | 313/292 |
| 2004/0161997 | A1 | 8/2004 | Ito et al. | 445/24 |

FOREIGN PATENT DOCUMENTS

| | | |
|---|---|---|
| EP | 0 851 459 A2 | 7/1998 |
| EP | 0 969 491 | 1/2000 |
| JP | 2000-30613 | 1/2000 |
| JP | 2000-192017 | 7/2000 |
| JP | 2000-311608 | 11/2000 |
| JP | 2000-311632 | 11/2000 |

* cited by examiner

*Primary Examiner*—Joseph Williams
*Assistant Examiner*—Bumsuk Won
(74) *Attorney, Agent, or Firm*—Fitzpatrick, Cella, Harper & Scinto

(57) ABSTRACT

An image display apparatus including a first substrate on which electron sources having electron-emitting devices are arranged, a second substrate forming a display image by being irradiated with electrons, and a spacer disposed between the first substrate and the second substrate, the spacer provided with an insulating substrate and a resistance film covering the insulating substrate. An area deeper in the resistance film into which a penetration of the electron is smaller is set to have lower resistance. Thereby, even if resistance is changed near the surface of the resistance film of the spacer by being exposed to the electron irradiation when the image display apparatus has been driven for a long time, the resistance value of the whole resistance film is almost kept to be a desired resistance value by means of the deeper area having the low resistance, and consequently the variation of the resistance value of the spacer resistance film, the variations of electron orbits owing to a change of a potential distribution, and the disturbance of image display caused by the potential distribution can be suppressed.

4 Claims, 6 Drawing Sheets

IMAGE DISPLAY APPARATUS HAVING SPACER WITH RESISTANCE FILM

BACKGROUND OF THE INVENTION

1. Field of the Invention

The present invention relates to an image display apparatus, and more particularly to a spacer for use in the image display apparatus having an electron-emitting device.

2. Description of Related Art

Because a plane type image display apparatus having a thin depth among image display apparatus using electron-emitting devices is a space-saving image display apparatus and light in weight, the plane type image display apparatus is noticed as a substitute for a Braun tube type display apparatus. FIG. 9 is a perspective view showing an example of a display panel unit of a plane type image display apparatus. FIG. 9 shows the display panel unit with a panel being partially broken for the illustration of an inner structure.

In the drawing, a reference numeral 3115 denotes a rear plate. A reference numeral 3116 denotes a side wall. A reference numeral 3117 denotes a face plate. The rear plate 3115, the side wall 3116 and the face plate 3117 constitute an envelope (airtight container) for keeping the inside of the display panel to be a vacuum.

A substrate 3111 is fixed to the rear plate 3115. An N×M cold-cathode elements 3112 are formed on the substrate 3111 (N and M are severally a positive integer being two or more, and are suitably set according to the aimed number of display pixels). Moreover, the N×M cold cathode elements 3112 are wired by means of M pieces of row direction wiring 3113 and N pieces of column direction wiring 3114, as shown in FIG. 9. A portion composed of the substrate 3111, the cold cathode elements 3112, the row direction wiring (upper wiring) 3113 and the column direction wiring (lower wiring) 3114 are totally called as a multi-electron beam source. Moreover, insulation layers (not shown) are formed between both of the row direction wiring 3111 and the column direction wiring 3114 at least at positions where they intersect with each other, and electrical insulation between them is held.

A phosphor film 3118 made of phosphor is formed on the under surface of the face plate 3117. The three primary colors, red (R), green (G) and blue (B), of phosphor (not shown) are separately coated as the phosphor film 3118. Moreover, a black body (not shown) is formed between each of the colors of phosphor constituting the phosphor film 3118. Furthermore, metal-backing 3119 made of aluminum or the like is formed on the surface of the phosphor film 3118 on the side of the rear plate 3115.

Reference marks Dx1-Dxm, Dy1-Dyn and Hv denote electrical connection terminals of the airtight structure provided for connecting the display panel with a not shown electric circuit electrically. The terminals Dx1-Dxm, Dy1-Dyn and Hv are electrically connected with the row direction wiring 3113 and the column direction wiring 3114 of the multi-electron beam source, and the metal backing 3119, respectively.

Moreover, the inside of the airtight container is held to be a vacuum at the degree of about $1.3\times10^{-4}$ Pa. As the display area of the image display apparatus becomes larger, means for preventing the rear plate 3115 and the face plate 3117 from being deformed or damaged owing to the difference of atmospheric pressure between the inside of the airtight container and the outside thereof becomes more necessary. A method of thickening the rear plate 3115 and the face plate 3116 generates distortion of an image and a parallax when the image display apparatus is seen from an oblique direction as well as the increase of the weight of the image display apparatus. Conversely, the image display apparatus shown in FIG. 9 is made of a relatively thin glass plate, and is equipped with structural supporting members (called as spacers or ribs) 3120 for supporting the glass plate against the air pressure. Thus, the distance between the substrate 3111, on which the multi-electron beam source is formed, and the face plate 3117, on which the phosphor film 3118 is formed, is ordinarily kept to be within a range of a submillimeter order to several millimeter order. Also, as described above, the inside of the airtight container is held to be a high vacuum.

When a voltage is applied to each of the cold cathode elements 3112 through the terminals Dx1-Dxm and Dy1-Dyn on the outside of the container of the above-described image display apparatus using the display panel, electrons are emitted from each of the cold cathode elements 3112. At the same time, a voltage within a range from several hundred volt to several kilovolt is applied to the metal backing 3119 through the terminal Hv on the outside of the container to accelerate the emitted electrons. The accelerated electrons collide with the inner surface of the face plate 3117. Thereby, each color phosphor constituting the phosphor film 3118 is excited to emit light, and an image is displayed.

However, there has been a problem that an image is displayed with distortion at positions near to the spacers. A part of the electrons emitted from the positions near to the spacers 3120 collides with the spacers 3120, or ions generated by the ionization caused by the operation of the emitted electrons attach the spacers 3120. By such causes, there is the possibility of causing spacer charging. The orbit of an electron emitted from a cold cathode element 3112 is bent by the charging of a spacer 1320, and the electron arrives at a position of the phosphor different from a correct position. Consequently, the image at the position near to the spacer is displayed with distortion. A method for solving the problem is disclosed in U.S. Pat. No. 5,760,538. In the method, a resistance film is formed on the surface of each spacer, and a small current flows through the resistance film for removing the charging of the spacer. Although the details of the causes of the charging have not been found, reflection electrons emitted from an electron-emitting device near to the spacer, and secondary electrons emitted from the surface of the spacer have been considered to be the causes. A method for improving the emission of these electrons is proposed in Japanese Patent Application Laid-Open No. 2000-311632.

SUMMARY OF THE INVENTION

In an display panel of an image display apparatus, a phenomenon of a disturbance of an image at a position near to a spacer can be sometimes observed when the image is displayed for a long time even if charging is removed by forming a resistance film on the surface of the spacer.

The present invention aims to provide an image display apparatus including a spacer which generates no disturbance of an image at a position near to the spacer even if the image display apparatus displays the image for a long time.

Moreover, the present invention aims to provide an image display apparatus including a spacer in which a change of resistance can be suppressed even if the spacer is exposed to an electron irradiation.

The present invention is an image display apparatus including a first substrate on which electrons sources having electron-emitting devices are arranged, a second substrate on which a body to be irradiated with electrons emitted from the electron sources are disposed, and a spacer disposed between the first substrate and the second substrate, the spacer provided with an insulating base substrate and a resistance film having a film thickness of d, the resistance film covering the insulating base substrate, the image display apparatus applying an acceleration voltage between the first substrate and the second substrate for irradiating said body with the electrons emitted from the electron sources, wherein the resistance film of the spacer has a sheet resistance Rs1 (Ω/□) from a surface of the insulating base substrate to a thickness of $(d-\alpha\lambda)$ and a sheet resistance Rs2 (Ω/□) from a surface of the resistance film to a thickness of $\alpha\lambda$, the resistance Rs1 being smaller than the resistance Rs2, where $\lambda$ is a penetration depth of the electron in the resistance film under the acceleration voltage, and $(d-\alpha\lambda)>0$, where $\alpha$ is equal to 0.1 or more.

DESCRIPTION OF THE PREFERRED EMBODIMENTS

Figure 1:
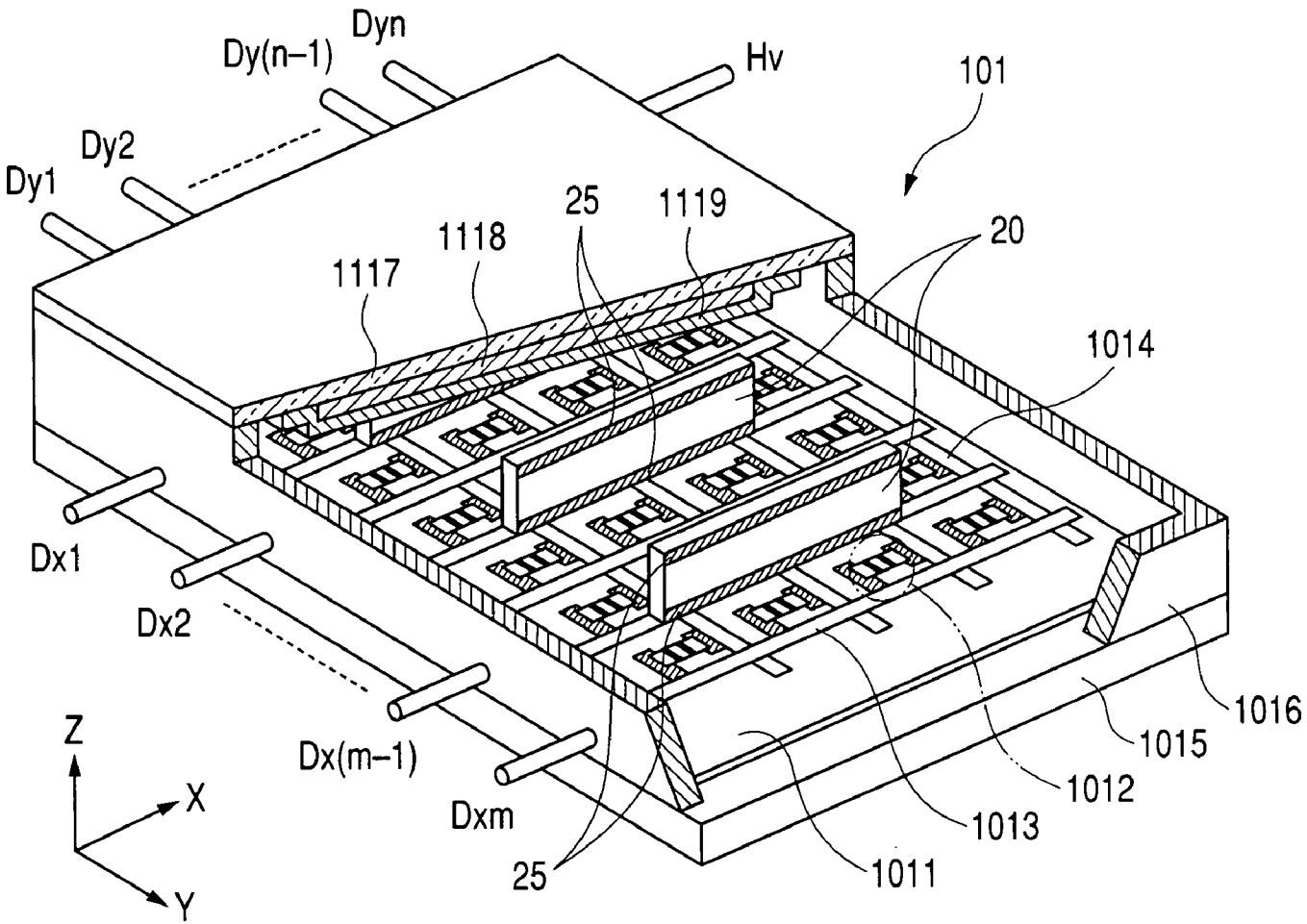
FIG. 1 is a perspective view showing an image display apparatus of an embodiment of the present invention.

The surface of a spacer to be used for an image forming apparatus is exposed to electrons at the time of image displaying. Consequently, even if a spacer having an insulating base substrate the surface of which is covered by a resistance film is used, the spacer is deteriorated with age during image-displaying for a long time, and a display image near to the spacer is disturbed. The degree of the disturbance of the display image slightly differs according to the drive condition of the display panel such as an accelerating voltage and the configuration of the panel. However, as a result of various examinations, the present inventor concluded that the change of the disturbance of an image owing to a long-time display was caused by a change of the resistance distribution of the resistance film. The change of the resistance distribution of the spacer causes a change of an electric potential distribution near to the spacer at the time of the operation of the image display apparatus. Consequently, the orbits of emitted electrons change to disturb the display image.

As a result of an examination based on the above-mentioned point of view, the present inventor found a spacer configuration in which, even when the resistance of a resistance film from a rear plate to a face plate is exposed to electron irradiation, the change of the resistance is sufficiently small and the change does not influence the electron orbits.

Even if the resistance of a resistance film has changed by being exposed to electron irradiation, the change is suppressed when the number of invading electrons into the resistance film is small. If the resistance of the film area at which the number of invasion electrons is small regulates the whole film resistance, the resistance distribution of the resistance film would scarcely change even if the resistance film is exposed to electron irradiation. That is, even if the resistance near to the surface of a film, which is exposed to electron irradiation, has changed over time, the film area located at a deeper part receives less invasion electrons, and the resistance of the deeper area scarcely changes. Consequently, if the film area located at the deeper area has resistance lower than that of the surface layer, the resistance distribution of the high resistance film is almost regulated by the low resistance area. Consequently, the change of the film resistance of the spacer from the rear plate to the face plate owing to long-time display is suppressed, and also the disturbance of the image near to the spacer is suppressed.

To put it concretely, the present invention is an image display apparatus including a first substrate on which electron sources having electron-emitting devices are arranged, a second substrate on which a body to be irradiated to which electrons emitted from the electron sources are radiated is disposed, and a spacer disposed between the first substrate and the second substrate, the spacer provided with an insulating base substance and a resistance film having a film thickness of d, the resistance film covering the insulating base substance, the image display apparatus radiating the electrons emitted from the electron sources to the body to be irradiated by applying an acceleration voltage between the first substrate and the second substrate, wherein the resistance film of the spacer has a sheet resistance Rs1 (Ω/□) from a surface of the insulating base substance to a thickness of $(d-\alpha\lambda)$ and a sheet resistance Rs2 (Ω/□) from a surface of the resistance film to a thickness of $\alpha\lambda$, the resistance Rs1 being smaller than the resistance Rs2, where $\lambda$ indicates a penetration depth for a primary electron of the resistance film at the acceleration voltage, and $(d-\alpha\lambda)>0$, where $\alpha$ is equal to 0.1 or more.

Moreover, in the above-mentioned present invention, it is preferable that the sheet resistance Rs1 and the sheet resistance Rs2 satisfy relations of $2 \leqq Rs2/Rs1 \leqq 100$ and $10^7 \leqq Rs1 \leqq 10^{14}$.

Moreover, in the preset invention, $\alpha$ is preferably 0.5 or more, and more preferably 1.0 or less.

Moreover, in the present invention, it is further preferable that the sheet resistance Rs1 and the sheet resistance Rs2 satisfy a relation of $10 \leqq Rs2/Rs1 \leqq 100$.

Moreover, in the present invention, it is preferable that a temperature coefficient of resistance of the resistance film within a range from a surface of the insulating substrate to a thickness of $(d-\alpha\lambda)$ is 3% or less.

Moreover, in the present invention, it is preferable that a range of the acceleration voltage is within a range from 4 kV to 30 kV.

Incidentally, the penetration depth for a primary electron in the present invention corresponds to an average depth of a solid body up to which an electron invades when the electron is accelerated by an acceleration voltage Hv and enters into the solid body perpendicularly to the surface of the solid body. The penetration depth for a primary electron was obtained by an experimental method, which will be described later.

Moreover, the sheet resistance Rs is a value indicated by $Rs=\rho/d$ ($\rho$ is resistivity, d is a film thickness). Generally, the resistance value R of a film is indicated by a relationship $R=\rho(L/(d'\times W)=Rs\ (L/W)$ (where $\rho$ is resistivity, d' is a film thickness, L is a length of the film, and W is a width of the film).

According to the present invention, a disturbance of an image near to a spacer at the time when an image display apparatus displays the image for a long time can be suppressed. Moreover, even if a temperature difference between the first substrate and the second substrate is generated in some use environment, the present invention has an effect capable of suppressing the disturbance of the image near to the spacer.

In the following, the preferable embodiments of the present invention will be describe with reference to the attached drawings.

FIG. 1 is a perspective view showing a display panel unit of an image display apparatus according to the present invention. FIG. 1 shows the display panel unit with a panel being partially broken for the illustration of the inner structure thereof. In FIG. 1, a reference numeral 1011 denotes a substrate mounting a plurality of electron-emitting portions thereon. A reference numeral 1012 denotes an electron-emitting device including an electron-emitting portion. A reference numeral 1013 denotes a piece of row direction wiring for driving the electron-emitting devices 1012. A reference numeral 1014 denotes a piece of column direction wiring. A reference numeral 1015 denotes a rear plate. A reference numeral 1016 denotes a side wall. A reference numeral 1117 denotes a face plate. The rear plate 1015, the side wall 1016 and the face plate 1117 constitute an airtight container for keeping the inside of the display panel to be a vacuum. It is needed to attach each member to each other at its joining area to be sealed for keeping sufficient strength and sufficient airtightness at the joining area. The attachment to be sealed can be achieved, for example, by coating frit glass at the joining area, and by burning the frit glass in the air at a temperature within a range from 400° C. to 500° C. for ten minutes or more. Because the inside of the airtight container is held to be a vacuum about at the degree of $10^{-4}$ Pa, spacers 20 are provided as resisting air pressure structures with the aim of preventing the airtight container from being crushed by the air pressure, a sudden shock or the like. Moreover, a reference numeral 1118 denotes a phosphor of a luminescent material provided on the inside of the face plate 1117. A reference numeral 1119 denotes metal-backing.

Figure 3:
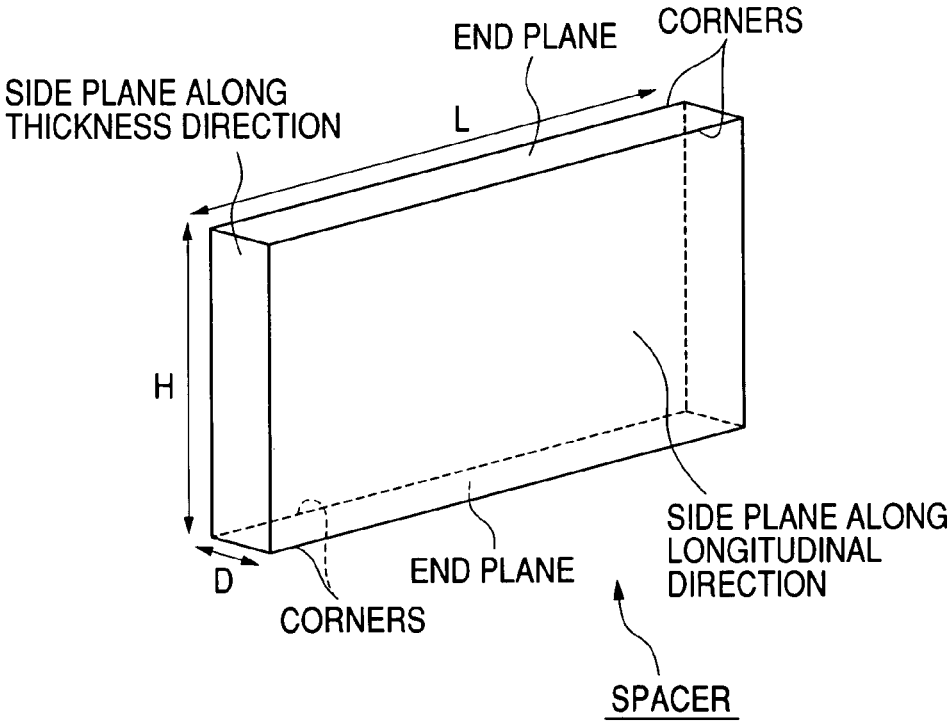
FIG. 3 is a perspective view of a spacer being an embodiment of the present invention.

FIG. 3 shows an example of the spacers 20. In the spacer 20, a high resistance film is formed on the surface of insulating substrate being an insulating base substance made of a ceramic, glass or the like. The quality of the material, the shapes, the arrangement and the arrangement number of the spacers 20 are determined after consideration of the air pressure, the heat and the like operating on the envelope based on the shape, the coefficient of thermal expansion and the like of the envelope. The shape of the spacer 20 includes a cross, a letter L, a circular cylinder, a hole formed at a part through which an electric beam passes, and the like, and the shape of the spacer 20 is not limited to the plane one shown in FIG. 3. That is, as the insulating base substance to be used as a ground of the high resistance film, ones having the shape of the cross, the letter L, the circular cylinder, and the hole formed at a part through which an electric beam passes can be used in addition to the insulating substrate.

Each of the insulating spacer substrates is preferably made of a material having a thermal expansion characteristic almost same as ones of the rear plate 1015, on which the electron-emitting devices 1012 are formed, and of the face plate 1117, on which the phosphor is formed. Moreover, owing to a thermal process among the processes of manufacturing the apparatus and the necessity of suspending the air pressure, a material such as glass, a ceramic or the like having a strong mechanical strength and high thermal resistance is suitable.

Although a spacer substrate is an insulator, the spacer substrate may have a resistance value at the degree of one of soda lime glass. The surface shape of the substrate may be smooth, but preferably is one having an uneven structure. The substrate used for the embodiment of the present invention has an uneven structure made by a heating drawing method described in Japanese Patent Application Laid-Open No. 2000-311608, but the method of forming the uneven structure is not limited to the heating drawing method. For example, a random shape formed by a sand-blasting method, a stripe shape disclosed in Japanese Patent Application Laid-Open No. 2000-311608, and further a shape formed by combining the two shapes may be adopted.

As a forming method of the unevenness, for example, the heating drawing method described in Japanese Patent Application Laid-Open No. 2000-311608, a grinding method, a blast method, an etching method, a lift-off method and the like can be applied. Moreover, as the need arises, it is also possible to perform shape control using an optical patterning or a mechanical mask. A roughly formed surface layer may be formed between the high resistance film and the surface of the substrate by means of a fine particle dispersion type film made by dispersing a silicon oxide or a metallic oxide into a binder matrix.

As the high resistance film, a metallic oxide, a metallic nitride and a carbide can be used. A tin oxide, a chromium oxide, a germanium oxide, an aluminum nitride, a germanium nitride or a carbon can be used with an added additive such as a metal as the need arises, and with the resistance thereof being controlled. However, the material of the high resistance film is not limited to the above-mentioned materials. Any material having a resistance capable of being adjusted and being stable can be used. Above all, composites of a transition metal or a noble metal and a ceramic, such as Au—$SiO_2$, Pt—$SiO_2$, Cr—$SiO_2$, Cr—$Al_2O_3$, $In_2O_3$—$Al_2O_3$ and W—Ge—O, composites of a transition metal and a nitride, such as W—Ge—N, W—Al—N, Cr—Al—N, Ti—Al—N, Ta—Al—N and Cr—B—N, Cr—Si—N, carbon, a carbon nitride and the like are more preferably.

Various methods can be applied to the control of the resistance in the thickness direction of a high resistance film. For example, the resistance adjustment of an aluminum nitride can be performed by adding tungsten. The configuration of the present invention can be achieved by changing the amount of the additive around the film thickness of 0.1 $\lambda$. The amount of the additive may be changed continuously.

Moreover, the high resistance film is not necessarily composed of the same compounds, and a multi-layer film composed of different compounds may be adopted. Moreover, a configuration in which the composition ratio of the high resistance film changing from the surface thereof to the interface with the substrate would be effective. The configuration is formed by means of processes such as the thermal diffusion of ions contained in the substrate to the film, the diffusion from the surface of the film to the inside of the film, and the oxidation of the film surface by high temperature annealing in the air.

As a method of producing the high resistance film, an existing production method of an antistatic film can be applied. For example, a sputtering process, a vacuum evaporation method, a chemical vapor deposition (CVD) process, a printing method, an aerosol method, a dipping method, and the like can be applied.

The spacers 20 produced in the manner as described above are arranged in the space between the rear plate 1015 and the face plate 1117 with a suitable intervals and being suitable in number for enduring the air pressure.

Figure 2:
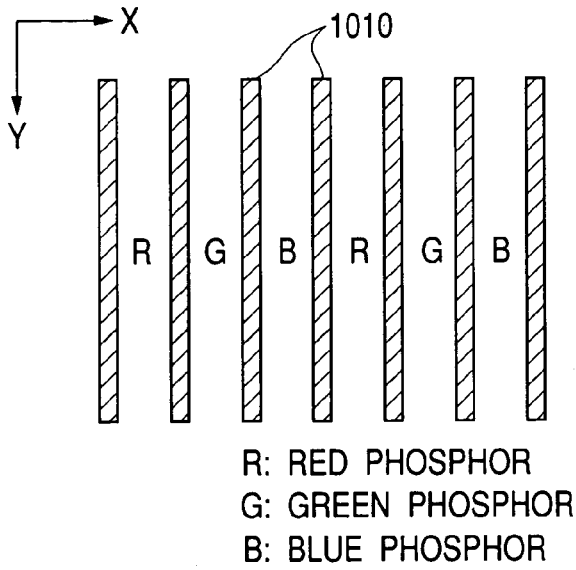
FIG. 2 is a plan view illustrating a phosphor arrangement of a face plate being an embodiment of the present invention.

The phosphor 1118 is formed on the under surface of the face plate 1117. Because the present embodiment is a color display apparatus, the phosphor 1118 each having one of the three primary colors of red, blue and green is separately coated. Each color phosphor 1118 is separately coated into, for example, a stripe as shown in FIG. 2. A black dielectric 1010 is formed between stripes of the phosphor 1118. The coating method of the three primary colors separately is not limited to the stripe arrangement, and the other arrangements may be used. Moreover, when a monochrome display panel is produced, a single color phosphor may be used. Furthermore, the black dielectric material is not always needed.

Moreover, the metal backing 1119 is formed on the surface of the phosphor 1118 on the side of the rear plate 1015. The metal backing 1119 is formed as follows. After the phosphor film 1118 has been formed on the face plate substrate 1117, the surface of the phosphor is processed to be smooth, and then aluminum is evaporated thereon in a vacuum.

As described above, the rear plate 1015 and the face plate 1117 are attached to each other to be sealed with the frit glass, and form an airtight container. After sufficient exhausting into a vacuum, the display panel is completed by sealing an exhaust pipe.

When a voltage is applied to each electron-emitting device through the terminals Dx1-Dxm and Dy1-Dyn on the outside of the container, electrons are emitted from the electron-emitting device. A high voltage of several kilovolts or more is applied to the metal backing 1119 through the terminal Hv on the outside of the container. The emitted electrons are accelerated by the voltage to collide with the face plate 1117. Thereby, the phosphor 1118 is excited to emit light, and an image is displayed.

By using the image display apparatus formed in the above-mentioned manner, a disturbance of an image near to a spacer 20 was evaluated. Hereupon, the disturbance of the image means a positional variation of a bright spot of an electron beam from an electron-emitting device near to the spacer 20 in the direction perpendicular to the spacer 20 when the electron beam is radiated onto the phosphor 1118. Because the magnitude of the variation of a beam position changes also according to the geometric configuration of the panel, the variation of the position near to the spacer 20 was evaluated on the basis of the standardization of the variation based on the amount of the variation to the device pitch L in the direction perpendicular to the spacer 20. That is, in the case where a certain acceleration voltage was applied to the display panel to display an image, the distance between the position of a light emitting bright spot nearest to a spacer 20 immediately after the display and the position after the image had been continuously displayed for three hours were standardized by means of the device pitch L. The standardized distance was set to be the deviation of an electron beam. The larger the deviation of the electron beam is, the larger the disturbance of a displayed image is. The image quality corresponding to the deviation of the bright spot was evaluated by a subjective image quality evaluation method. As a result, the deviation at the level at which deterioration can be known but the deviation is not on the user's mind was about 0.1 L.

Next, the characteristics of the high resistance film will be described.

Figure 4A:
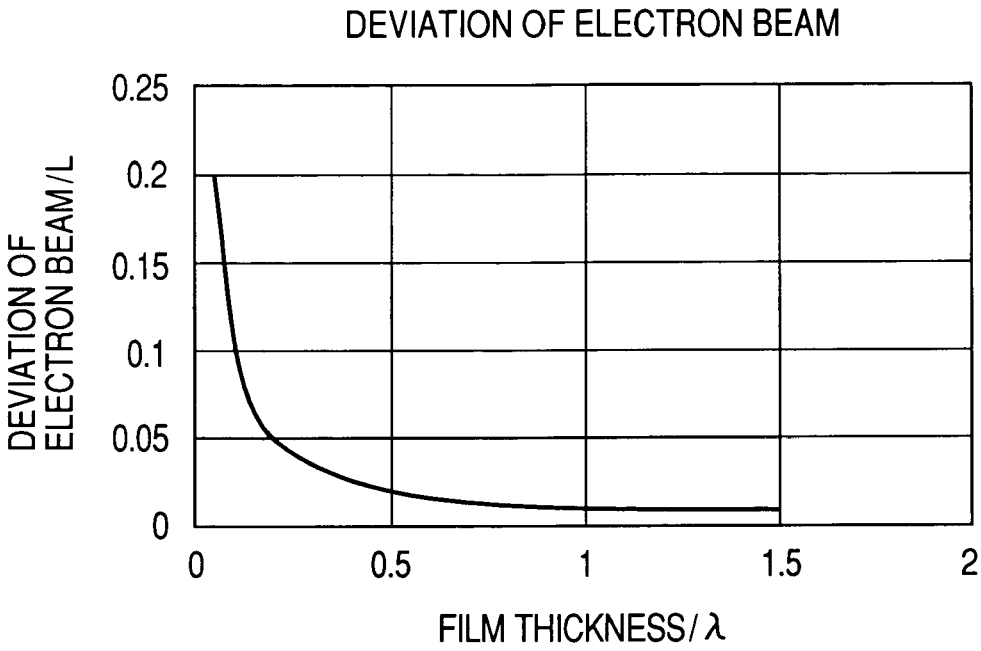
FIGS. 4A and 4B are views showing characteristics of the deviations of electron beams of high resistance films being embodiments of the preset invention.
Figure 4B:
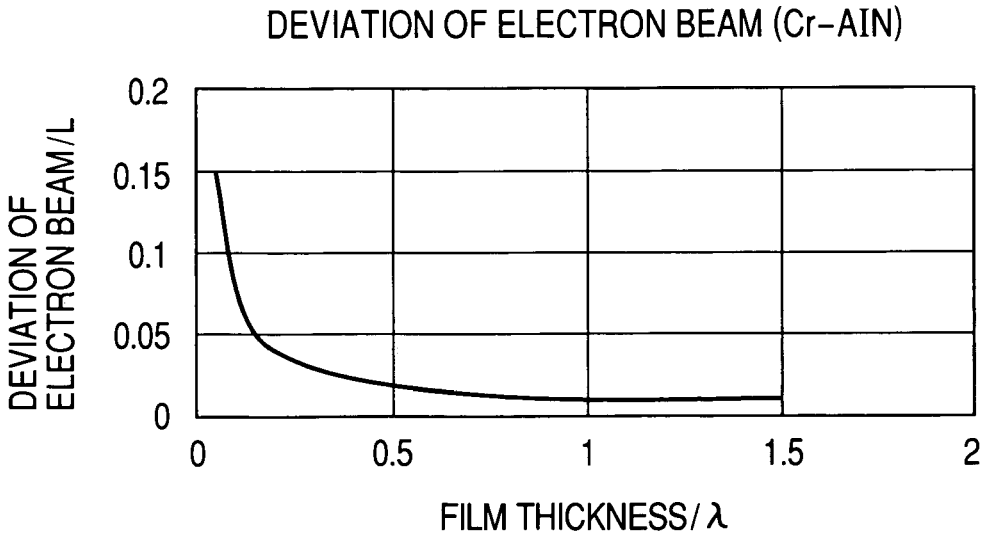

FIGS. 4A and 4B show the deviations of electron beams before and after the display for three hours in case of using a spacer 20 on which a high resistance film having a changed thickness of the upper layer was formed by setting the film configuration to be Rs2/Rs1=2, where Rs1 indicates the sheet resistance of a lower layer and Rs2 indicates the sheet resistance of an upper layer. The lower layer was set to be in a fixed condition of both of the film thickness and the sheet resistance, and the addition amount of W into the upper layer was finely adjusted accompanied by the change of the film thickness of the upper layer. Thereby, the resistance ratio Rs2/Rs1 was made to be 2.

As the high resistance film, a W—GeN film was formed by the sputtering method. A nitride film was formed by performing simultaneous sputtering of targets made of Ge and W in a mixed atmosphere of an argon gas and a nitrogen gas. The resistance of the film was controlled in order that the resistance ratio of an upper layer and a lower layer might be constant by changing electric power of the W target. The film thickness value of the upper layer was standardized by the penetration depth for a primary electron λ.

The penetration depth for the primary electron λ to the acceleration voltage of 10 kV of the W—GeN film formed hereupon was 0.7 μm by a measurement, which will be described later. As apparent in FIG. 4A, when the film thickness of the Rs2 layer is 0.1 λ or more, the deviation of the electron beam is shown to be about 0.1 L or less. More preferably, the film thickness of Rs2 is 0.5 λ or more, and furthermore preferably, the film thickness of Rs2 is 1.0 λ or more. Because the characteristic scarcely changes in the area of 1.0 λ or more, the film thickness of Rs2 is sufficient when it is 1.0 λ or more. Although the high resistance film made of W—GeN was used hereupon, the effect of the high resistance film was not caused limitedly from the material. FIG. 4B shows a relationship between the deviation of an electron beam and the film thickness of an Rs2 film with regard to a Cr—AlN film. The Cr—AlN film was formed by sputtering of targets made of Al and Cr in the mixed atmosphere of Ar and nitrogen. The penetration depth for a primary electron λ at the acceleration voltage of 10 kV was 1.5 μm. Also hereupon, when the film thickness of the Rs2 layer is 0.1 λ or more similarly to the W—GeN film, the deviation of the electron beam is 0.1 L or less. More preferably, the film thickness is 0.5 λ or more. When the film thickness is 1.0 λ or more, the deviation of the electron beam is saturated.

Figure 5:
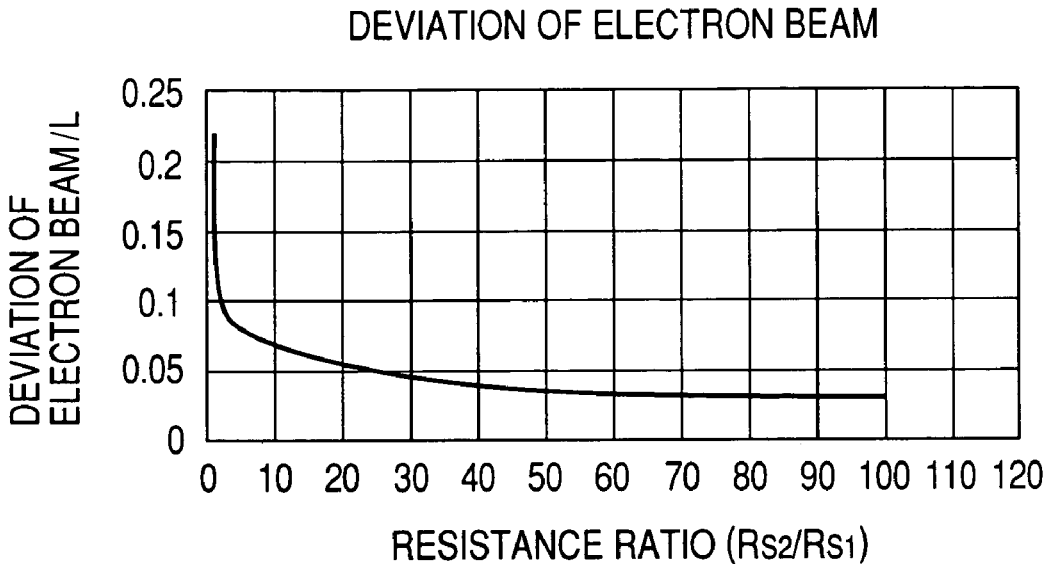
FIG. 5 is a view showing a characteristic of the deviation of an electron beam of a high resistance film being an embodiment of the preset invention.

FIG. 5 shows the deviation of an electron beam when the sheet resistance Rs1 of a lower layer was changed without changing the film formation condition of the Rs2 layer of the W—GeN film, i.e. with the film thickness and the resistance thereof being fixed to be constant (hereupon, the film thickness corresponding to 0.1 λ). When the resistance ratio (Rs2/Rs1) of the upper layer (having the resistance Rs2) and the lower layer (having the resistance Rs1) was changed from 1 to about 100, the deviation of the electron beam was rapidly reduced as the resistance ratio becomes larger. It is found that the deviation of the electron beam becomes 0.1 line or less when the Rs2/Rs1 is two or more. Consequently, the resistance ratio Rs2/Rs1 is preferably within a range from 1 to 100, and the resistance ratio Rs2/Rs1 is more preferably within a range from 2 to 100. In particular, as a region in which stability can be obtained in manufacturing the film, the resistance ratio Rs2/Rs1 is preferably within a range from 10 to 100. Also hereupon, although the W—GaN film was used, the effect is not limited to that material.

Moreover, the effect described above can not be necessarily obtained from the two-layer configuration. As long as the ratio of the sheet resistance Rs1 of a film area on the front side to the depth of 0.1 λ when the penetration depth for the primary electron is taken as a standard and the sheet resistance Rs2 of a film area on the spacer substrate side is within a range from 1 to 100, the above-mentioned effect can be obtained. Consequently, the film configuration is not limited to the two-layer configuration. Even if the resistance continuously changes in the film thickness direction, or even if the film takes a multi-layer configuration, the similar effect can be obtained as long as the relationship mentioned above is satisfied.

Also, when the input electric power of the W target is changed to be smaller as time elapses while the input electric power of the Ge target is kept to be constant at the time of forming the above-mentioned W—GeN film on a spacer substrate for forming the high resistance film, the similar effect can be obtained. The resistance distribution in the film thickness direction in this case was measured as follows.

Figure 6:
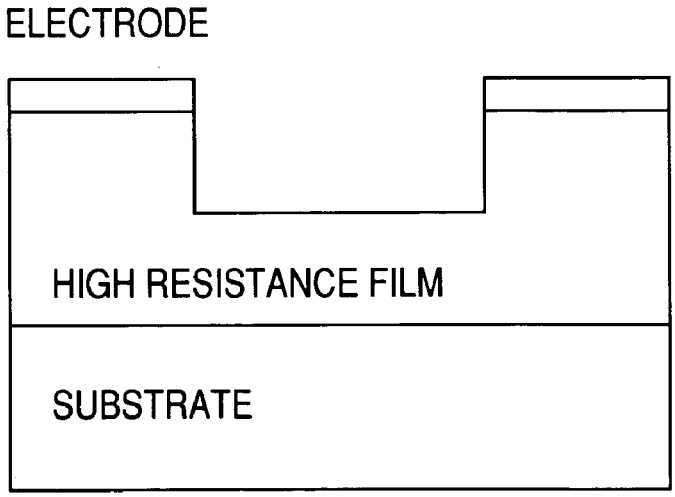
FIG. 6 is an explanatory view of an etching method of a high resistance film being an embodiment of the present invention.
Figure 7:
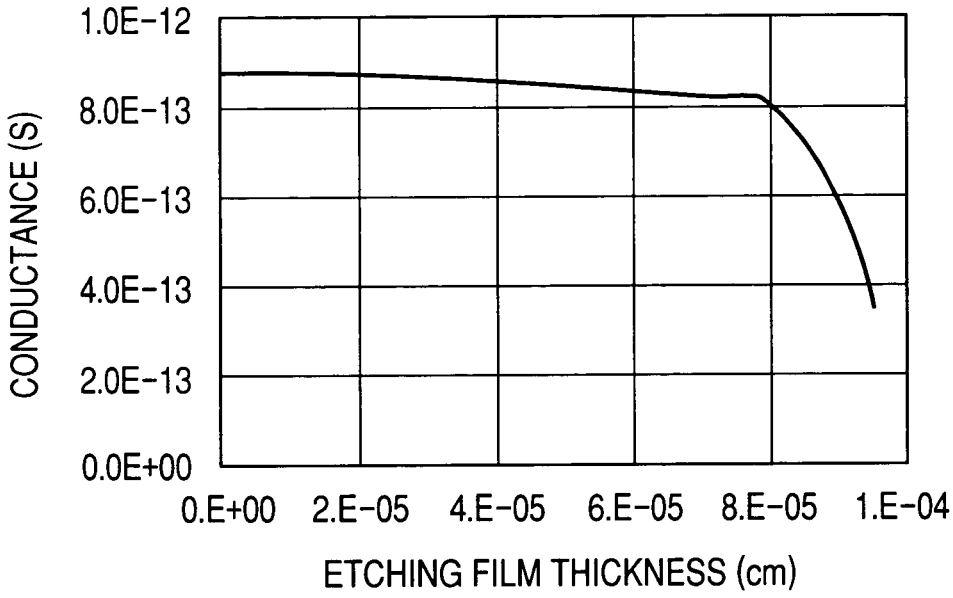
FIG. 7 is a view showing an electric characteristic when a high resistance film being an embodiment of the present invention is etched.

First, a spacer 20 was cut into an appropriate size. Metallic electrodes were formed on a high resistance film by means of a metal backing 1119 (see FIG. 6). After the conductance between electrodes at this time was measured, the area between the electrodes was processed by dry etching. Next, the etched film thickness was measured, and the conductance between the electrodes was measured. The measurements were repeated to measure the conductance between the electrodes to the etching film thicknesses. The results of the measurements were shown in FIG. 7. In FIG. 7, for example, a sign 1.0E-12 indicates $1.0\times10^{-12}$.

Even if the resistance continuously changes, and even if the film is configured to be a multilayer, as described above, the similar effect can be obtained as long as the ratio of Rs2 to Rs1 is within a range from 2 to 100. The resistance distribution can be measured by the method described above.

Moreover, the lower limit of the resistance value of the high resistance film of a spacer 20 is determined in order not to cause a thermal runaway.

Because the resistance value rises as the temperature rises in the case where the temperature coefficient of resistance is positive, the heat generation at the spacer 20 is suppressed. Conversely, in the case where the temperature coefficient of resistance is negative, the resistance decreases owing to the heat rising by the electric power consumed on the surface of the spacer 20, and then the temperature continues to rise, so that an excessive current flows. That causes the so-called thermal runaway. Strictly speaking, the thermal runaway is influenced by the thermal contact of the spacer 20 with the rear plate 1015 or the face plate 1117, or the like. The present inventor performed experiments under various configurations and conditions, and found that, when the electrical power consumption per 1 $cm^2$ of a high resistance film exceeded about 0.1 W, the current flowing through a spacer 20 continued to increase to cause a thermal runaway. It is preferable that the resistance value at which the electric power consumption per 1 $cm^2$ does not exceed 0.1 W is $10^7$ Ω or more.

Moreover, it is necessary that a current sufficient for the rapid static elimination of charges flows without charging on the surface of the high resistance film coated on the spacer 20, and the current is controlled by the resistance value. The amount of charging of the surface of the resistance film depends on the emitted electrons from an electron source and a secondary electron emitting rate of the high resistance film. When the sheet resistance is $10^{14}$ Ω/□ or less, the resistance film can deal with almost all use conditions. For obtaining a sufficient charge prevention effect, the sheet resistance is more preferably $10^{13}$ Ω/□ or less.

Because much of the current components of the high resistance film according to the present invention is carried by the area in the height of (d−αλ) from the insulating substrate (d indicates the film thickness of the high resistance film) against the penetration depth for a primary electron λ, the sheet resistance Rs1 of the film area of the thickness of (d−αλ) from the insulating substrate is $10^7$ Ω/□ or more, and is preferably $10^{14}$ Ω/□ or less.

Moreover, the temperature coefficient of resistance of the high resistance film of the spacer 20 influences the deviation of an electron beam also. When a temperature difference between the face plate 1117 and the rear plate 1015 is generated under some use environment in an image display apparatus arranging the spacers 20 therein, a phenomenon in which the resistances of the high resistance film on the face plate side and on the rear plate side differ from each other is generated owing to a temperature difference because the high resistance film of a spacer 20 has a temperature dependency. Because the resistance difference influences electron orbits, the resistance difference changes a beam. In the high resistance film of the present invention, the potential gradient of the acceleration voltage from the face plate 1117 to the rear plate 1015 in the area from the insulating substrate to the position at the film thickness of (d−αλ) is dominant. Consequently, the temperature coefficient of resistance in this area is important. The present inventor examined the temperature differences between the face plate 1117 and the rear plate 1015, and relations between the deviations of an electron beam and the temperature characteristics of the resistance of the high resistance film. As the results of the examination, the following facts can be experimentally found. That is, the temperature differences between the face plate 1117 and the rear plate 1015 almost converge within 15° C. in an ordinary use environment, and the temperature coefficient of resistance at which the variation amount of the beam converges within 0.1 L is within 3%. The high resistance film of the present invention preferably has a temperature coefficient of resistance being within 3% at the thickness of $(d-\alpha\lambda)$ from the surface of the insulating substrate.

Moreover, the penetration depth for a primary electron λ of the high resistance film was obtained from measurement values of an energy dispersive X-ray micro analyzer as follows. First, a high resistance film the film thickness of which was known was formed on a smooth substrate including elements other than the elements constituting the high resistance film. Electron beams are radiated on the surface of the film at various acceleration voltages. When the acceleration voltage of an electron gun is large, an electron passes through the film to reach the substrate (ground), on which the film is formed. Not only the characteristic X-rays of the elements constituting the film are generated, but also the characteristic X-rays of the elements constituting the substrate are generated. When the acceleration voltage is decreased, the strength of the characteristic X-ray signal of the elements constituting the substrate also decreases. By means of the energy dispersive X-ray micro analyzer, the acceleration voltage by which the signals of the elements constituting the substrate cannot be detected is obtained, and a voltage value subtracted by the minimum excitation potential of the elements constituting the substrate is obtained. Then the film thickness is the penetration length for a primary electron λ to the voltage value.

It is desirable to include an element having the minimum excitation potential as low as possible for heightening the measurement accuracy of the penetration length for a primary electron λ.

Moreover, the penetration length for a primary electron λ to each voltage can be obtained as follows. As a high resistance film, W—GeN films having different film thicknesses were formed on an alumina substrate. Electrons were radiated to each of the substrate from the surface of the films. Acceleration voltages at which no signals of the alumina elements included in the grounds could be detected were obtained. Voltages obtained by subtracting the minimum excitation potential of alumina from each acceleration voltage and the film thicknesses, i.e. the penetration depths for primary electrons 1 are plotted, and are fitted to the following formula.

$\lambda=\kappa E^n$ (E: a value obtained by subtracting an excitation voltage from an acceleration voltage (input energy of a primary electron); κ, n: constants)

By obtaining the constants κ and n in the above formula on the basis of experimental results, the penetration length for a primary electron λ to the acceleration voltage of the material can be obtained.

The above-mentioned method is one of obtaining the penetration length for a primary electron λ after preparing samples having different film thicknesses. Without the samples having different film thicknesses, the penetration length for a primary electron λ can be similarly obtained by etching a film. Moreover, in the case where a film is not suitable for measurement because the substrate and the film have a common element, an appropriate material suitable for measurement is coated on the surface of the substrate by evaporating or the like, and then a glass plate or the like is adhered. Then, if the original substrate (spacer substrate) is removed by etching, the penetration length for a primary electron λ can be similarly obtained.

Next, examples of the present invention will be described.

Characteristics of a spacer 20 were evaluated by means of a display panel as shown in FIG. 1. A voltage of 10 kV was applied to the high voltage terminal Hv. As shown in FIG. 3, as the spacer substrate, a high strain point glass having a shape of a height H=3 mm, a thickness D=2 mm, and a length L=40 mm was used. On the surface of the glass, an irregularity shape was formed. The pitch of the irregularity shape was 30 mm, and the depth thereof was 10 mm.

Oxides and nitrides shown in the following Table 1 were formed on the above-mentioned spacer substrate to be evaluated. All of the films had two-layer configuration including changes of Rs1 and Rs2. Formation conditions were as follows. Sputtering was performed in the gas pressure within the range of 0.5–3 Pa. W—GeO films were formed by simultaneous sputtering using W and $GeO_2$ as targets in an $Ar+O_2$ atmosphere. Pt—SiO films were formed by simultaneous sputtering using Pt and SiO as targets in an $Ar+O_2$ atmosphere. Cr—AlN films were formed by simultaneous sputtering using Cr and Al as targets in an $Ar+N_2$ atmosphere. Moreover, an Al—SnO film was formed by dispersing $SnO_2$ fine particles, to which Al was added, into an organic solvent, and by dipping a substrate therein to anneal at 400° C. in the air for making a lower layer (having a sheet resistance Rs1) . The W—GeO films ware made to be upper layers (having a sheet resistance Rs2) similarly to the above. A C—N film was formed on the substrates by decomposing a $C_2H_2+N_2$ gas in a plasma to be formed on the substrate. At that time, the substrate was heated at 250° C. Incidentally, the changes of composition rates of the materials of high resistance films when resistance variations (variations of sheet resistance) were small, and the penetration depths for primary electrons λ were small (for example, even if a W/Ge ratio was made to be five times, the penetration depths for primary electrons λ increased only by 5%). That is, even if sheet resistance was changed by changing the composition ratios of the materials of the high resistance films, the penetration depths for primary electrons λ changed only by a negligible degree, and the composition ratios of the materials of the high resistance films can be appropriately set for resistance adjustment.

The penetration depths for primary electrons of these films at 10 kV were as follows. The thicknesses of the Rs2 layers in Table 1 are shown up to the depth of 0.1 λ from the surfaces.

| Materials | Penetration Depths For Primary Electrons (λ) |
|---|---|
| W—GeO films | 0.8 μm |
| Pt—SiO films | 0.7 μm |
| Cr—AlN films | 1.5 μm |
| C—N films | 1.8 μm |

TABLE 1

| MATERIAL | Rs1 (Ω) | Rs1 THICKNESS (μm) | Rs2 (Ω) | Rs2 THICKNESS (μm) | Rs2/Rs1 | DEVIATION (L) | FORMING METHOD |
|---|---|---|---|---|---|---|---|
| WGeO | 5.00E+10 | 0.5 | 5.5E+11 | 0.08 | 11 | 0.06 | SPUTTERING |
| WGeO | 4.00E+12 | 0.5 | 3.72E+14 | 0.08 | 93 | 0.03 | SPUTTERING |
| AlSnO | 4.00E+07 | 0.05 | | | | | DIPPING |
| WGeO | | | 8.8E+08 | 0.08 | 22 | 0.05 | SPUTTERING |
| Pt—SiO | 7.00E+09 | 0.1 | 2.45E+11 | 0.07 | 35 | 0.04 | SPUTTERING |
| Pt—SiO | 5.00E+11 | 0.5 | 4.35E+13 | 0.07 | 87 | 0.03 | SPUTTERING |
| Cr—AlN | 5.00E+13 | 0.1 | 3.4E+15 | 0.15 | 68 | 0.04 | SPUTTERING |
| Cr—AlN | 1.00E+14 | 0.5 | 9E+14 | 0.15 | 9 | 0.06 | SPUTTERING |
| C—N | 3.00E+12 | 0.5 | 9.6E+13 | 0.18 | 32 | 0.02 | CVD |
| CO. EX. | | | | | | | |
| WGeO | 5.00E+10 | 0.5 | | | | | SPUTTERING |
| Pt—SiO | 5.00E+11 | 0.5 | | | | | SPUTTERING |

As described above, the deviations of electron beams of any high resistance films of the embodiments were 0.1 L or less.

Figure 8:
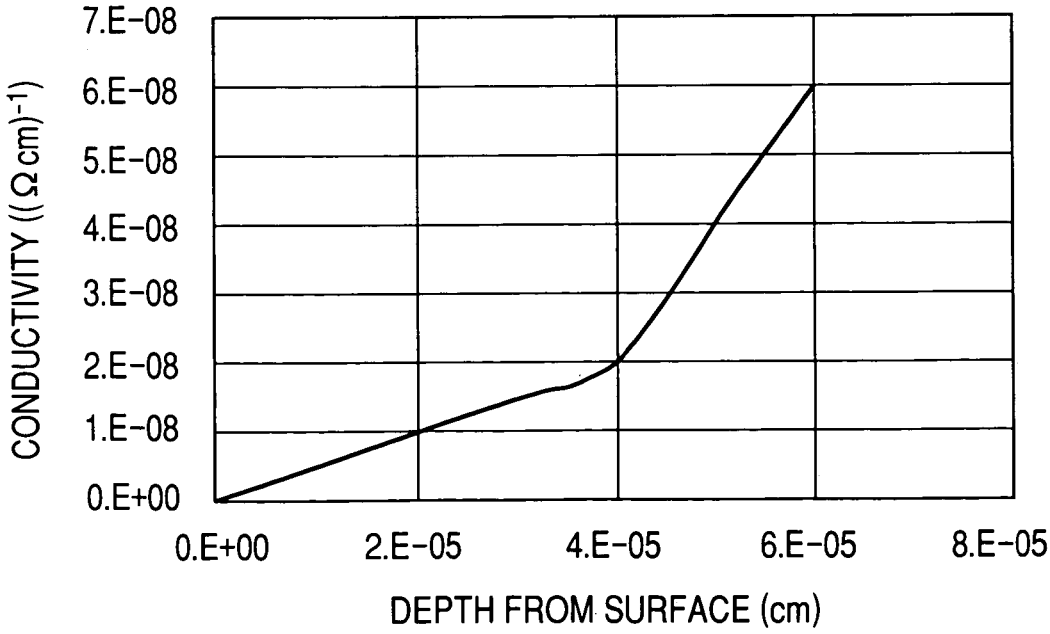
FIG. 8 is a view showing an electric characteristic when a high resistance film being an embodiment of the present invention has a resistance distribution.
Figure 9:
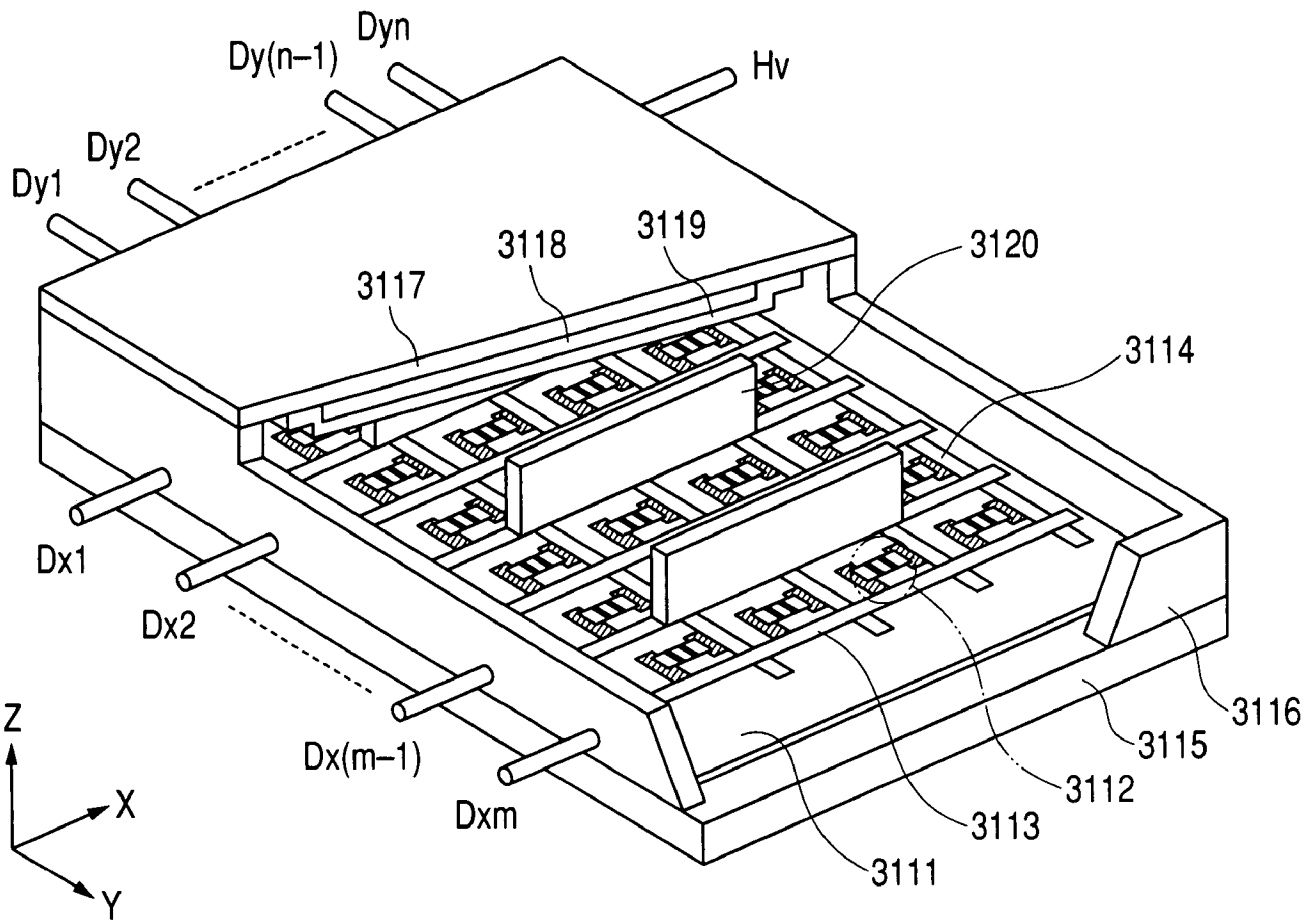
FIG. 9 is a perspective view showing a partially broken display panel of a conventional image display apparatus.

A W—GeN film was formed on a spacer substrate being similar to one of the example 1 by the sputtering. Simultaneous sputtering was performed to the targets of W and Ge in the atmosphere of $Ar+N_2$. The change of the resistance was controlled by changing the input electric power to W as the elapse of time. The film thickness of the produced film was 0.6 μm, and the sheet resistance of the whole high resistance film was $8.3\times10^{11}$ Ω. The resistance distribution was obtained by measuring the conductivity of each point after dry etching as described above. FIG. 8 shows the conductivity to depths from the surface layer obtained by etching. By changing acceleration voltage (by changing the penetration depth for a primary electron λ) to the W—GeN film having such a distribution, the deviations of electron beams were evaluated like in the example 1. The results are shown in the following.

| ACCELERATION VOLTAGE (Kv) | PENETRATION DEPTH FOR PRIMARY ELECTRON (μm) | Rs1 (Ω) | Rs2/Rs1 | DEVIATION OF ELECTRON BEAM |
|---|---|---|---|---|
| 13 | 1.0 | $8.5 \times 10^{11}$ | 47 | 0.03 L |
| 19 | 2.0 | $9.1 \times 10^{11}$ | 11 | 0.03 L |
| 24 | 3.0 | $1.0 \times 10^{12}$ | 4 | 0.07 L |
| 29 | 4.0 | $1.3 \times 10^{12}$ | 2 | 0.09 L |

In any high resistance films, in the case where the resistance ratios standardized by the penetration depths for primary electrons were within a range of 2<Rs2/Rs1<100, the deviations of electron beams were 0.1 or less.

The film thicknesses of the Rs2 layers are 0.1 λ. The film thicknesses of the Rs2 layers at 10 kV are λ at 10 kV (1 μm)×0.1=0.1 μm.

A W—GeN film was formed as a high resistance film on a spacer substrate being similar to one of the example 1 by the sputtering with the formation conditions being changed. The film was formed under the pressure of an $Ar+N_2$ atmosphere being within a range of 0.5–3.0 Pa, with the partial pressure of $N_2$ being with the range of 10–60%. The temperature coefficient of resistance of the W—GeN film is negative, and the temperature coefficient of resistance at around the room temperature is 6% or less. The temperature coefficient of resistance changed according to formation conditions. By heating the display panel from the face plate side thereof with a rubber heater, temperature differences between the face plate 1117 and the rear plate 1010 were generated. The results of the deviations of electron beams caused by the temperature differences are shown in the following. An acceleration voltage was set to be 10 kV.

| SAMPLE NUMBER | TEMPERATURE COEFFICIENT OF RESISTANCE | Rs1 (Ω) | Rs2/Rs1 | TEMPERATURE DIFFERENCE (° C.) | DEVIATION OF ELECTRON BEAM |
|---|---|---|---|---|---|
| 1 | 1.6% | $5 \times 10^7$ | 56 | 15 | 0.06 L |
| 2 | 2.5% | $8 \times 10^{12}$ | 23 | 15 | 0.08 L |
| 3 | 2.8% | $7 \times 10^{13}$ | 12 | 15 | 0.09 L |
| (COMPARATIVE EXAMPLES) | | | | | |
| 4 | 3.3% | $2 \times 10^{13}$ | 8 | 15 | 0.13 L |
| 5 | 4.7% | $3 \times 10^{13}$ | 14 | 15 | 0.20 L |

As the result shown above, in the case where the temperature coefficient of resistance of the film at the position of the thickness of (d−0.1 λ) from the insulating substrate is within 3%, the variation amount of electron beams is suppressed within 0.1 L.

The present invention can be applied to an image display apparatus required not to generate disturbances of images near to the spacers even if the image display apparatus is displayed for a long time.

This application claims priority from Japanese Patent Application No. 2003-292408 filed Aug. 12, 2003, which is hereby incorporated by reference herein.

What is claimed is:

1. An image display apparatus including a first substrate on which electron sources having electron-emitting devices are arranged, a second substrate on which a body to be irradiated with electrons emitted from said electron sources are disposed, and a spacer disposed between said first substrate and said second substrate, said spacer provided with an insulating base substrate and a resistance film having a film thickness of d, said resistance film covering said insulating base substrate, said image display apparatus applying an acceleration voltage between said first substrate and said second substrate to accelerate the electrons emitted from said electron sources, wherein said resistance film of said spacer has a sheet resistance Rs1 (Ω/□) from a surface of said insulating base substrate to a thickness of (d−αλ) and a sheet resistance Rs2 (Ω/□) from a surface of said resistance film to a thickness of αλ, said resistance Rs1 and said resistance Rs2 satisfy the following relationships:

$$2 \leqq Rs2/Rs1 \leqq 100, \text{ and}$$

$$10^7 \leqq Rs1 \leqq 10^{14},$$

wherein λ is a penetration depth of the electron in said resistance film under the acceleration voltage, and (d−αλ)>0, where α is in a range of 0.5 to 1.

2. An image display apparatus according to claim 1, wherein said sheet resistance Rs1 and said sheet resistance Rs2 satisfy a relation of 10≦Rs2/Rs1≦100.

3. An image display apparatus according to claim 1, wherein a temperature coefficient of resistance of said resistance film within a range from a surface of said insulating substrate to a thickness of(d−αλ) is 3% or less.

4. An image display apparatus according to claim 1, wherein a range of said acceleration voltage is within a range from 4 kV to 30 kV.

* * * * *

UNITED STATES PATENT AND TRADEMARK OFFICE

CERTIFICATE OF CORRECTION

PATENT NO. : 7,145,288 B2
APPLICATION NO. : 10/915399
DATED : December 5, 2006
INVENTOR(S) : Yasushi Shimizu It is certified that error appears in the above-identified patent and that said Letters Patent is hereby corrected as shown below:

COLUMN 1:

Line 39, “wiring 3111” should read --wiring 3113--.

COLUMN 2:

Line 21, “volt” should read --volts-- and “kilovolt” should read --kilovolts--;
Line 32, “attach” should read --attach to--;
Line 52, “an” (first occurrence) should read --a--; and
Line 67, “electrons” should read --electron--.

COLUMN 3:

Line 32, “preset” should read --present--; and
Line 35, “preset” should read --present--.

COLUMN 4:

Line 55, “preset” should read --present--.

COLUMN 5

Line 24, “describe” should read --described--.

COLUMN 6:

Line 8, “almost” should read --almost the--; and
Line 54, “preferably.” should read --preferably used.--.

COLUMN 7:

Line 15, “intervals” should read --interval--.

COLUMN 9:

Line 7, “i.e.” should read --i.e.,--;
Line 17, “the” should read --the resistance ratio--; and
Line 24, “W-GaN” should read -- W—GeN--.

UNITED STATES PATENT AND TRADEMARK OFFICE

CERTIFICATE OF CORRECTION

PATENT NO. : 7,145,288 B2
APPLICATION NO. : 10/915399
DATED : December 5, 2006
INVENTOR(S) : Yasushi Shimizu It is certified that error appears in the above-identified patent and that said Letters Patent is hereby corrected as shown below:

COLUMN 11:

Line 47, "an" should be delete and "substrate." should read --substrates.--;
Line 48, "substrate" should read --substrates--; and
Line 54, "i.e." should read --i.e.,--.

COLUMN 12:

Line 22, "irregularity" (both occurrences) should read --irregular--.

COLUMN 13:

Line 51, "the" (second occurrence) should be deleted.

COLUMN 15:

Line 3, "the" (first occurrence) should be deleted;
Line 6, "with" should read --within--; and
Line 13, "plate 1010" should read --plate 1015--.

COLUMN 16:

Line 52, "of(d-αλ)" should read --of (d-αλ)--.

Signed and Sealed this

Twenty-seventh Day of May, 2008

JON W. DUDAS
*Director of the United States Patent and Trademark Office*